US007101065B2

(12) United States Patent
Bayer

(10) Patent No.: US 7,101,065 B2
(45) Date of Patent: Sep. 5, 2006

(54) ARRANGEMENTS AND METHODS FOR MOUNTING DECORATIVE ORNAMENTS AND FIXTURES HAVING DECORATIVE ORNAMENTS

(75) Inventor: George Bayer, Plattsburgh, NY (US)

(73) Assignee: Schonbek Worldwide Lighting Inc., Plattsburgh, NY (US)

( * ) Notice: Subject to any disclaimer, the term of this patent is extended or adjusted under 35 U.S.C. 154(b) by 310 days.

(21) Appl. No.: 10/757,628

(22) Filed: Jan. 14, 2004

(65) Prior Publication Data

US 2005/0152149 A1 Jul. 14, 2005

(51) Int. Cl.
*F21V 17/00* (2006.01)

(52) U.S. Cl. ..... 362/433; 362/441; 362/330

(58) Field of Classification Search ..... 362/249, 362/252, 330, 311, 312, 383, 455, 456, 404, 362/405, 408, 433, 441, 442, 806, 457, 458
See application file for complete search history.

(56) References Cited

U.S. PATENT DOCUMENTS

| | | | | |
|---|---|---|---|---|
| 3,820,201 | A | 6/1974 | Burckhardt | 24/87 R |
| 5,104,082 | A | 4/1992 | Bayer | 248/303 |
| 5,109,325 | A | 4/1992 | Bayer et al. | 362/433 |
| 5,116,009 | A | 5/1992 | Bayer | 248/303 |
| 5,144,541 | A | 9/1992 | Schonbek | 362/405 |
| 5,241,460 | A | 8/1993 | Schonbek | 362/405 |
| 5,285,364 | A | 2/1994 | Bayer | 362/405 |
| 5,573,330 | A | 11/1996 | Lucas | 362/405 |
| D397,494 | S | 8/1998 | Bayer et al. | D26/154 |
| 5,906,430 | A | 5/1999 | Bayer | 362/404 |
| 5,921,668 | A | 7/1999 | Bayer | 362/404 |
| 6,854,868 | B1 * | 2/2005 | Wu | 362/405 |

FOREIGN PATENT DOCUMENTS

| | | |
|---|---|---|
| DE | 2127913 | 12/1972 |
| DE | 3913470 C1 | 10/1990 |
| EP | 0 200 924 A2 | 11/1986 |

* cited by examiner

*Primary Examiner*—Laura K. Tso
(74) *Attorney, Agent, or Firm*—Heslin Rothenberg Farley & Mesiti P.C.; John Pietrangelo

(57) ABSTRACT

Arrangements and methods for mounting decorative ornaments and fixtures having decorative ornaments are disclosed. The decorative ornaments may be, for example, beads, crystals, or gems. In one aspect, an arrangement is provided including a frame having an aperture and the aperture having an internal surface, and at least one ornament mounting post projecting from the frame, wherein the ornament is retained by the mounting post and the internal surface of the aperture when the ornament is mounted on the mounting post. According to the disclosed method, the ornament is mounted to the post by first deflecting the post to a first position, mounting the ornament, and then deflecting the post to its original position whereby the ornament is retained by the post and the aperture. No mounting hardware or special tools are required. The arrangements and methods may be used for ornamental fixtures, for example, chandeliers and lamps.

32 Claims, 11 Drawing Sheets

ARRANGEMENTS AND METHODS FOR MOUNTING DECORATIVE ORNAMENTS AND FIXTURES HAVING DECORATIVE ORNAMENTS

FIELD OF THE INVENTION

This invention relates, generally, to arrangements for and methods for mounting decorative ornaments, for example, crystals and beads, more particularly, to arrangements and methods for mounting decorative ornaments to lighting fixtures, such as chandeliers.

BACKGROUND OF THE INVENTION

The design of chandeliers, lamps, and various other decorative items often involves the need to attach decorative ornaments or crystal components (for example, octagonal or circular beads, pendants, and other ornaments) to supporting metal frames. According to prior art practice, the attachment of these ornaments to the frames typically requires the use of wires, hooks, or other fastening means, and may require special tools. In addition, prior art mounting arrangements and methods typically require multiple fabrication and assembly steps, multiple parts and/or materials, and are labor intensive and costly to perform. Also, simple prior art wire mounting methods do not generally allow for the desired positioning or orientatating of some components, such as jewels, pendalogs, or pear shaped pendants, though conventional hooks may provide some orientatating of such ornaments, for example, with the aid of gravity. Systems allowing for the orientation of such components other than by gravity generally require complex and expensive brackets, hooks, or other attachment means. Aspects of the present invention overcome these disadvantages of the prior art, among others, when mounting ornaments in decorative fixtures.

SUMMARY OF ASPECTS OF THE INVENTION

According to aspects of the present invention, ornament mounting arrangements and mounting methods which are easy to fabricate and assemble are provided. Mounting arrangements include frames having an aperture with a geometry that provides a receptacle (for example, a receiving slot, or a pocket) having a mounting post that is adapted to receive and retain an ornament. The present invention also provides an ornament mounting frame that can be fabricated in a single operation, for example, stamping, to produce the pocket and mounting pin. Contrary to prior art arrangements and methods, in aspect of the invention, no additional component parts are needed to attach the ornaments to the mounting frames. In addition, aspects of the present invention provide for the mounting of ornaments whereby the orientation of the ornaments can be controlled, for example, with little or no influence by gravity, without the need for brackets, hooks, or other attachment means. Aspects of the present invention are adaptable to a broad range of frame and ornament configurations and can accommodate a wide variety of different ornaments. In contrast to prior art methods, in aspects of present invention, the assembly of ornaments to frames is simple and labor efficient, for example, the number of parts is minimized and there is no requirement for special tools.

One aspect of the present invention is an arrangement for mounting a decorative ornament including a frame having an aperture, the aperture having an internal surface; and at least one mounting post projecting from the frame, the mounting post adapted for insertion through a perforation in the ornament; wherein the ornament is retained by the mounting post and the internal surface of the aperture when the ornament is mounted to the mounting post. In one aspect of the invention, the mounting post is flexible and adapted for deflection from a first position to a second position for mounting the ornament.

Another aspect of the invention is a method for mounting a decorative ornament to a frame having an aperture and a flexible mounting post, the aperture having an internal surface, the method including the steps of deflecting the mounting post from a first position to a second position; mounting the ornament on the mounting post in the second position; deflecting the mounting post having the ornament to the first position; and retaining the ornament in the aperture by means of the mounting post and the internal surface of the aperture. In one aspect of the invention, the aperture defines a plane, wherein in the first position the mounting post is substantially parallel to the plane and in the second position the mounting post is substantially non-parallel to the plane.

A further aspect of the invention is an ornamental fixture including a frame having at least one aperture, the at least one aperture having an internal surface; and at least one mounting post projecting from the frame, the mounting post adapted for insertion through a perforation in the ornament; wherein the ornament is retained by the at least one mounting post and the internal surface of the at least one aperture when the ornament is mounted to the at least one mounting post. In one aspect of the invention, the ornamental fixture is an ornamental light fixture, for example, a lamp or chandelier.

A still further aspect of the invention is an arrangement for mounting a decorative ornament having an axis and a mounting hole that does not pass through the center of gravity of the ornament, the arrangement including a frame having a surface and the frame having an aperture having an internal surface; and at least one mounting post projecting from the frame, the mounting post adapted for insertion through the mounting hole of the ornament; wherein when the ornament is mounted to the mounting post, the axis of the ornament makes an angle greater than 0 degrees with the vertical.

Thus, aspects of the present invention provide for improved arrangements and methods for mounting ornaments to and to ornamental fixtures, for example, ornamental lighting fixtures.

BRIEF DESCRIPTION OF THE FIGURES

The subject matter that is regarded as the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF FIGURES

Figure 1:
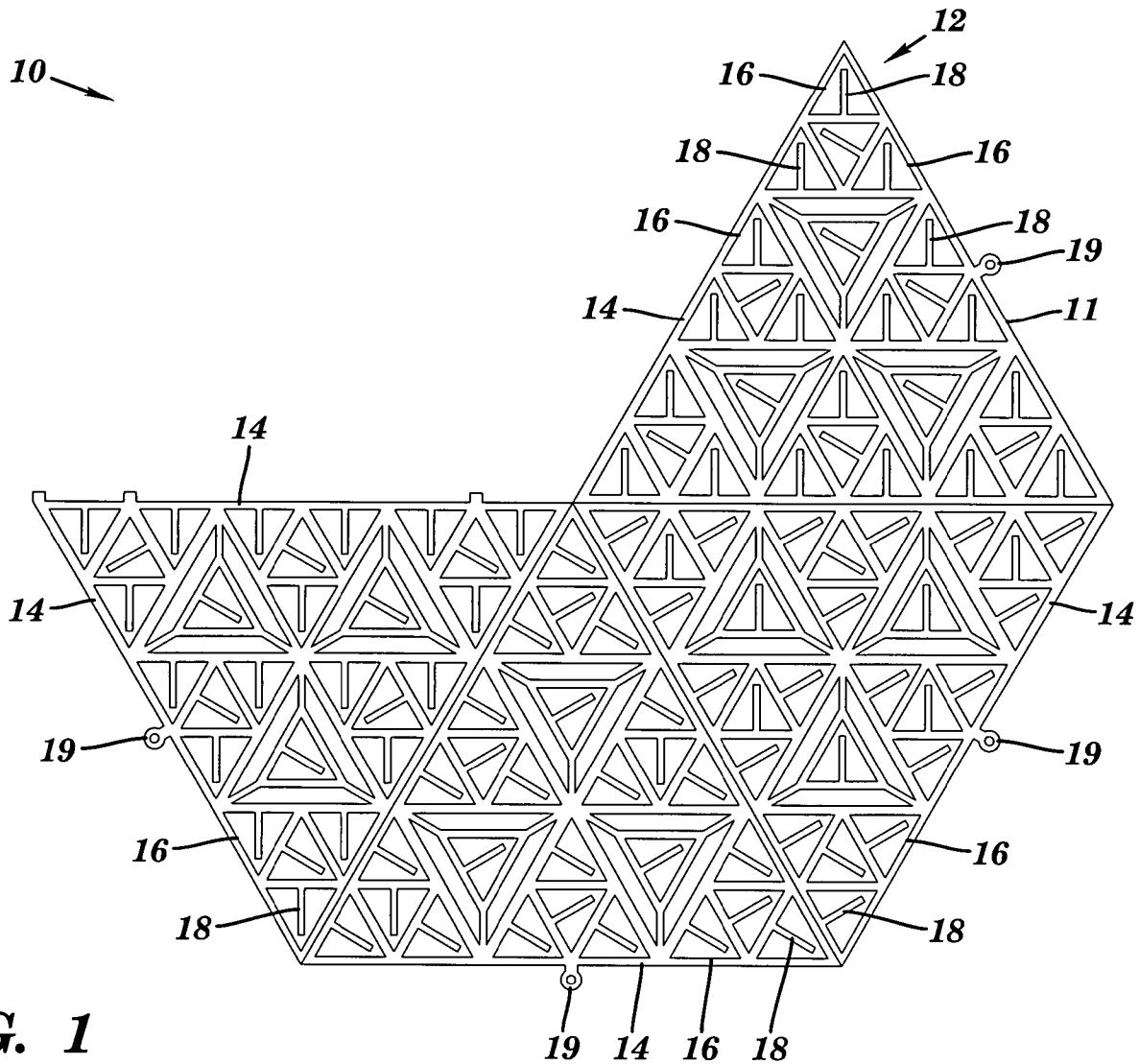
FIG. 1 is a plan view of an ornament retaining frame having ornament retaining angements according to one aspect of the present invention.

The details and scope of aspects of the present invention can best be understood upon review of the attached figures and their following descriptions. FIG. 1 is a plan view of an ornament retaining fixture 10 comprising a frame 11 and ornament retaining arrangements 12 according to one aspect of the present invention. In the aspect of the invention shown, frame 11 comprises a plurality of individual triangular perforated frame panels 14. According to this aspect of the invention, frame 11 is illustrated in a pre-assembled state, that is, prior to the assembly of frame panels 14 into a polygonal shape, for example, the triangular-shaped ornamental fixture shown in FIGS. 7A and 7B. According to the present invention, frame 11 includes a plurality ornament retaining arrangements 12 having apertures 16 with each aperture 16 having one or more mounting pins 18 for mounting ornaments. Frame 11 may also include means 19 for hanging fixture 10, for example, eyelets, hooks, or other conventional structures for hanging fixture 10.

Figure 2:
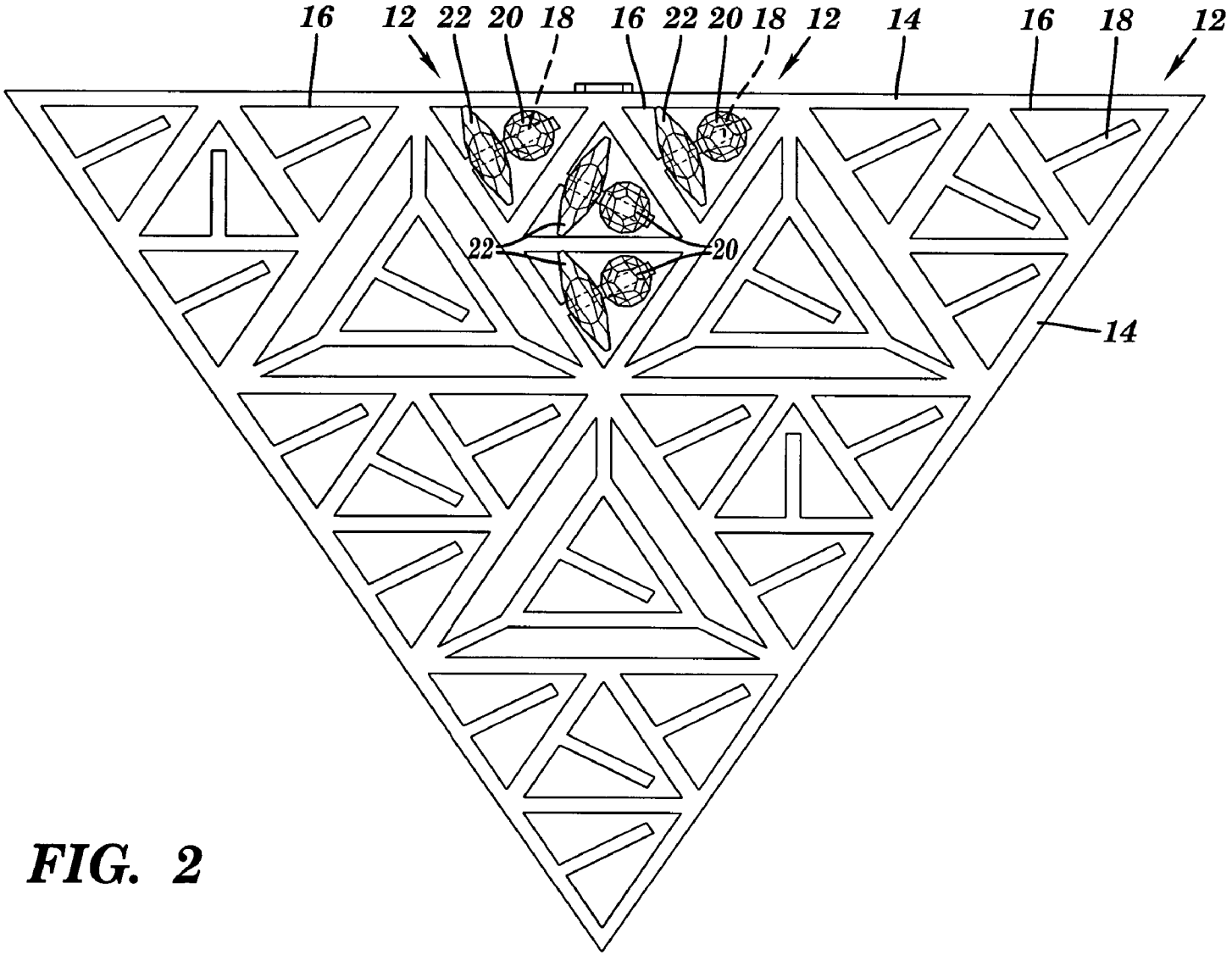
FIG. 2 is a plan view of a plurality of ornaments mounted in a frame panel shown in FIG. 1 according to one aspect of the present invention.

FIG. 2 illustrates a plan view of one frame panel 14 having a plurality of ornaments 20, 22 mounted therein on mounting pins 18 according to one aspect of the present invention. For clarity of illustration, only a representative set of ornaments 20, 22 are shown in FIG. 2. According to this aspect of the invention, ornaments 20, 22 may comprise perforated ornaments, that is, ornaments having a through hole. Ornaments 20, 22 may be perforated beads or crystals, for example, multifaceted octagonal beads or multifaceted spherical beads. According to one aspect of the invention, ornaments 20, 22, and all ornaments discussed herein, may comprise any type of perforated bead, stone, crystal, or the like that may be used in decorative fixtures. For example, according to one aspect of the invention, ornaments 20, 22 may comprise any type of faceted or non-faceted (that is, smooth) shape, for example, spheres, cubes, cones, bars, tubes, rods, prisms, and the like. Ornaments 20, 22 may be made from glass, plastic, metal, stone, or any other conventional material from which ornamental beads are typically made. Ornaments 20, 22 may also comprise perforated gems, for example, diamonds, rubies, sapphires, opals, and the like. Ornaments 20, 22 may be made from a transparent, translucent, or opaque material, for example, colored glass. In one aspect of the invention, ornaments 20, 22 may also comprise illuminated ornaments, such as, lights or light-emitting diodes (LEDs).

According to one aspect of the invention, frame 11 may be made from any conventional material, for example, any conventional metallic or non-metallic plate or sheet material. In one aspect of the invention, frame 11 may be made from a metal plate or sheet, for example, iron, steel, stainless steel, aluminum, titanium, nickel, magnesium, copper, silver, gold, or any other metal conventionally used in ornamental fixtures. In one aspect of the invention frame 10 may be made from plastic, for example, polyethylene (PE), polypropylene (PP), polyester (PE), polytetraflouroethylene (PTFE), or acrylonitrile butadiene styrene (ABS), among other plastics. In one aspect of the invention, frame 11 may be made from a material that is transparent, translucent, or opaque. In one aspect of the invention, frame 11 comprises a flexible material, for example, a flexible material capable of undergoing elastic or plastic deformation or deflection. In one aspect of the invention, frame 11 is fabricated from a plate or sheet having a thickness of between about 0.010 inches and about 0.5 inches, for example, between about 0.020 inches and about 0.25 inches, typically, between about 0.020 inches and about 0.050 inches.

Figure 3:
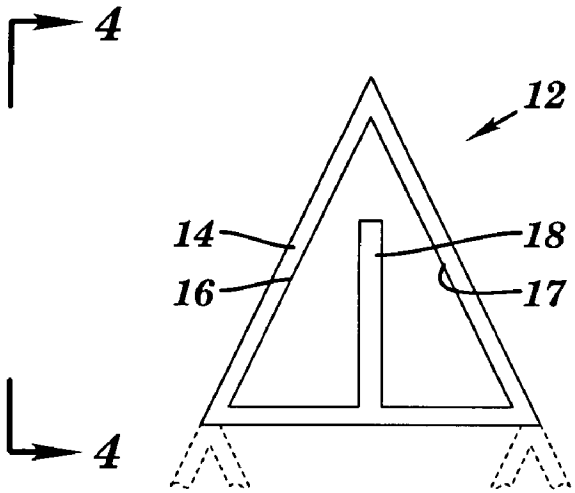
FIG. 3 is a detailed view of the ornament retaining arrangement shown in FIGS. 1 and 2.

FIG. 3 illustrates a detailed plan view of mounting arrangement 12 shown in FIGS. 1 and 2. According to this aspect of the invention, arrangement 12 includes a triangular aperture 16 in frame 11 and at least one mounting post or pin affixed to frame 11 and projecting into aperture 16. In the aspect of the invention shown in FIG. 3, aperture 16 is triangular in shape; however, according to one aspect of the invention, aperture 16 may comprise any shaped hole, slot, or cut-out in frame 11, for example, a circular, ellipsoidal, triangular, square, rectangular, or any polygonal-shaped aperture, among others. In one aspect of the invention, aperture 16 comprises a closed shape, that is, a shape having a continuous uninterrupted internal surface 17. In another aspect of the invention, aperture 16 may be an open shape, that is, a shape have internal surface 17 that is discontinuous or interrupted.

The cross-section of mounting post 18 may take any appropriate shape. Mounting post 18 may be circular, ellipsoidal, rectangular, square, or polygonal shape. In one aspect of the invention, mounting post 18 may be polygonal in shape, for example, rectangular, but have rounded corners that result from the method of fabrication, for example, the rounded corners typically encountered on punched or die-pressed shapes. Mounting post 18 may have a thickness (for example, diameter) that is larger or smaller than the thickness of frame 11, though in one aspect of the invention, the thickness of mounting post 18 is about equal in the thickness of frame 11, for instance, mounting post 18 is fabricated from the same plate or sheet material as frame 11.

As shown in FIG. 3, in one aspect of the invention mounting post 18 may be mounted to frame 11 whereby mounting post 18 projects into aperture 16. In one aspect of the invention, mounting post 18 may be mounted to frame 11 whereby mounting post 18 is substantially perpendicular to an internal surface 17 of aperture 16. In one aspect of the invention, mounting post 18 may be mounted to frame 11 whereby mounting post 18 is substantially non-perpendicular to an internal surface 17 of aperture 16. Mounting post 18 may be mounted integrally with the internal surface 17 of aperture 16 wherein the upper surface of mounting post 18 is substantially coplanar with the upper surface of frame 11, for example, when mounting post 18 and frame 11 are fabricated from the same material, for example, cut, die cut, or punched from the same material, that is, from the same sheet or plate. In one aspect of the invention, at least one of aperture 16 and mounting post 18 may be fabricated by laser cutting, water-jet cutting, electro-discharge machining (EDM), for example, wire-EDM, among other conventional fabrication methods. In one aspect of the invention, cutting of one of aperture 16 and post 18 may practiced with the aid of a computer control. In one aspect of the invention, at least one of aperture 16 and mounting post 18 may be fabricated by lithographic methods, for example, photolithographic methods.

In another aspect of the invention, mounting post 18 may be mounted on the upper surface of frame 11 or the lower surface of frame 11, whereby mounting post 18 projects above or below aperture 16, for example, when aperture 16 is produced by drilling, punching, or any of the cutting methods referenced above. In one aspect of the invention, mounting post 18 may be mounted above the upper surface of frame 11 or below the lower surface of frame 11 and project into aperture 16 at an oblique angle, for example, non-parallel to either the upper or the lower surface of frame 11. In one aspect of the invention, mounting post 18 may be mounted to frame 11 by any conventional means, for example, by means of welding (for example, resistance welding), brazing, with an adhesive, or by means of mechanical fasteners.

Figure 4:
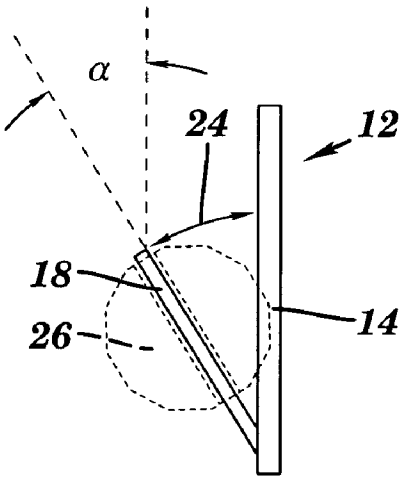
FIG. 4 is a side view of the ornament retaining arrangement shown in FIG. 3 as wed along view-lines 4—4 with the mounting post deflected.

FIG. 4 is a side view of the ornament retaining arrangement 12 shown in FIG. 3 as viewed along view lines 4—4. FIG. 4 illustrates one aspect of the invention in which mounting post 18 may be deflected to a second position, for example, as shown by double arrow 24, for mounting one or more perforated ornaments 26 (shown in phantom) onto mounting post 18. For example, in one aspect of the invention, mounting post 18 may be deflected, either manually or automatedly, as shown by double arrow 24 from a first position substantially parallel to the plane of frame 11 to a second position substantially non-parallel to the plane of frame 11. For example, in one aspect of the invention, mounting post 18 may be deflected an angle $\alpha$ of at least 5 degrees from the horizontal, for example, at least 15 degrees or at least 30 degrees from the horizontal, whereby ornament 26 may be mounted to mounting post 18. In one aspect of the invention, aperture 16 defines a plane and angle $\alpha$ is measured relative to the plane defined by aperture 16, for example, relative to a plane defined by the upper edge, lower edge, or mid-plane of aperture 16. Again, mounting post 18 may be deflected an angle $\alpha$ of at least 5 degrees from the plane defined by aperture 16, for example, at least 15 degrees or at least 30 degrees.

The mounting of ornament 26 on mounting post 18 may be effected by simply sliding the perforation (or through hole) of the ornament over the mounting post 18. According to the present invention, the deflection of mounting post 18 and the mounting of one or more ornaments 26 on mounting post 18 may be practiced manually or by automated means, for example, by means of a robotic actuator. In one aspect of the invention, ornament 26 may be mounted to post 18 with the aid of an adhesive. In another aspect of the invention, before or after mounting ornament 26 on post 18, post 18 may be deformed, for example, mechanically bent or kinked, to provide an obstruction which assists in retaining ornament 26 on post 18. In one aspect of the invention, the angle of deflection a may be dependent upon the size of ornament 26 and angle $\alpha$ must be sufficient to allow the mounting of ornament 26 on mounting post 18, for example, without interference from frame 11.

According to the present invention, the deflection of mounting post 18 may comprise elastic deflection, where mounting post 18 elastically returns from the second, deflected, position to essentially the first, non-deflected, position without the application of external force. The deflection of mounting post 18 may also comprise plastic deflection where mounting post 18 retains the second, deflected, position and must be forcibly returned to the first, non-deflected, position.

Figure 5:
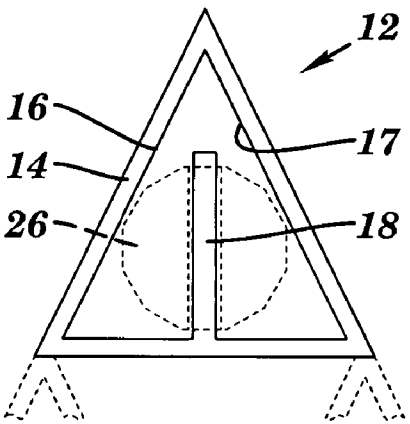
FIG. 5 is a detailed view similar to FIG. 3 showing the mounting of a representative ornament (in phantom.)

FIG. 5 is another detailed view similar to FIG. 3 showing the mounting of the representative ornament 26 (in phantom) in aperture 16 after mounting post 18 is returned to the first, non-deflected, position after the mounting of ornament 26. As shown in FIG. 5, ornament 26, which may be one or more ornaments, is retained in aperture 16 by mounting post 18 and the internal surfaces 17 of aperture 16. Specifically, the mounting of perforated ornament 26 on mounting post 18 prevents ornament 26 from moving perpendicular to the plane of FIG. 5, the bottom surface of aperture 16 prevents ornament 26 from moving downward in the plane of FIG. 5, and the two angled internal surfaces 17 of aperture 16 prevent ornament 26 from slipping off the end of mounting post 18. As a result, this aspect of the present invention provides an effective arrangement and method for mounting and retaining one or more ornaments in a frame of an ornamental fixture, for example, a chandelier, which are characterized by ease of fabrication and ease of assembly, for instance, without the need for additional mounting hardware or the need for special tools.

Figure 6:
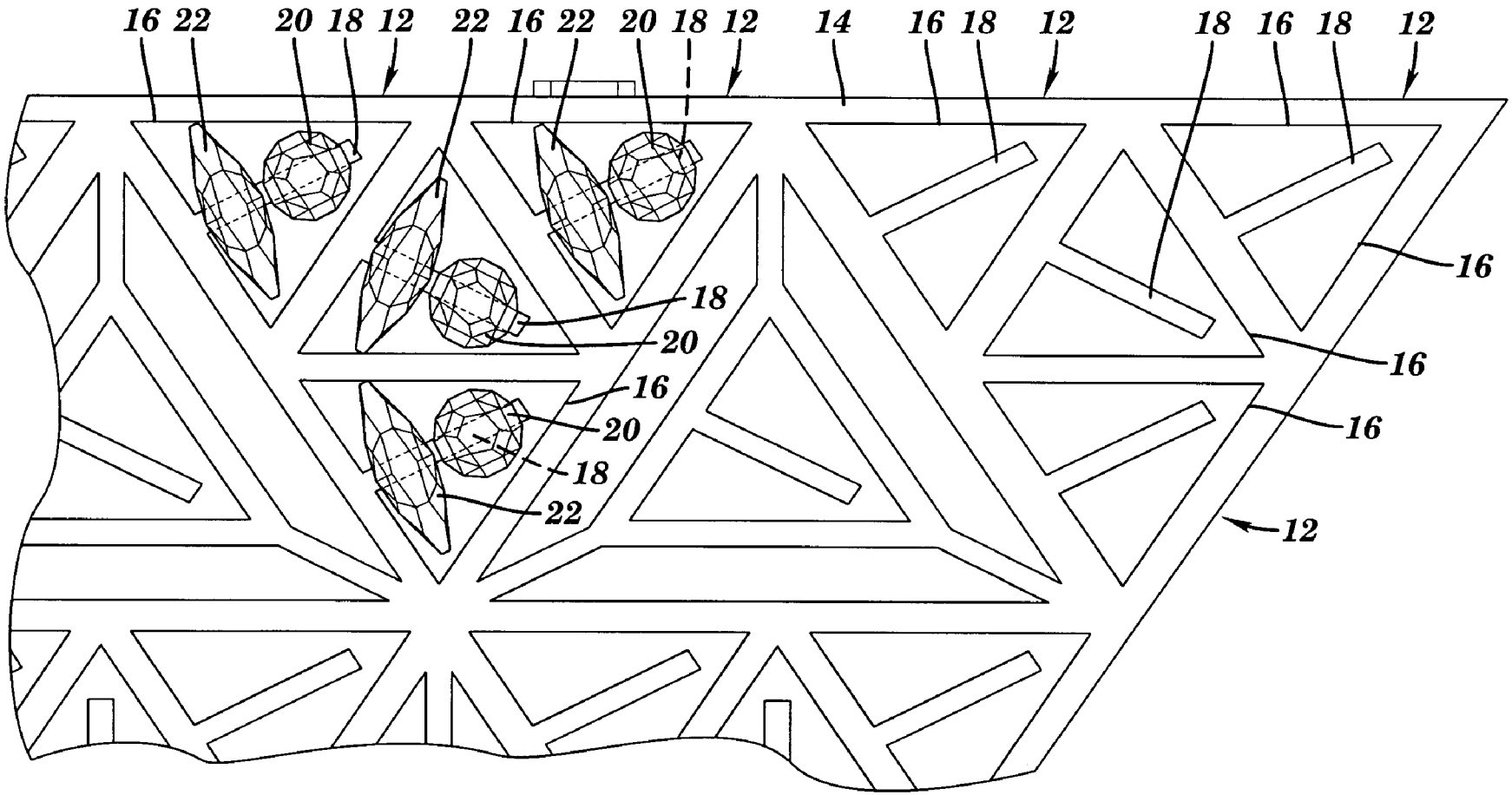
FIG. 6 is a detailed view of the mounting arrangement shown in FIG. 5.

FIG. 6 is a detailed view of frame 11 shown in FIG. 1 and mounting arrangement 12 shown in FIG. 2 assembled as described with respect to FIGS. 3 through 5. In the aspect of the invention shown in FIG. 6, a representative section of frame panel 14 of frame 11 showing four (4) mounting arrangements 12 having ornaments 20, 22 is shown. Each mounting arrangement 12 comprises a triangular aperture 16, a mounting post 18, and two ornaments 20, 22 mounted on each mounting post 18. In this aspect of the invention, ornament 20 comprises a multifaceted, spherical crystal bead and ornament 22 comprises a multifaceted, octagonal crystal jewel. Spherical bead 20 includes a through hole directed substantially along the axis of bead 20. Octagonal crystal jewel 22 includes a through hole that is not directed along the axis of jewel 22, but is off-set from the axis of the jewel, but substantially parallel to the axis of jewel 22. Mounting arrangement 12 may be used alone or with multiple similar or different arrangements in an ornamental fixture, for example, ornamental light fixture, for instance, a chandelier, lamp, or wall sconce.

Figure 7A:
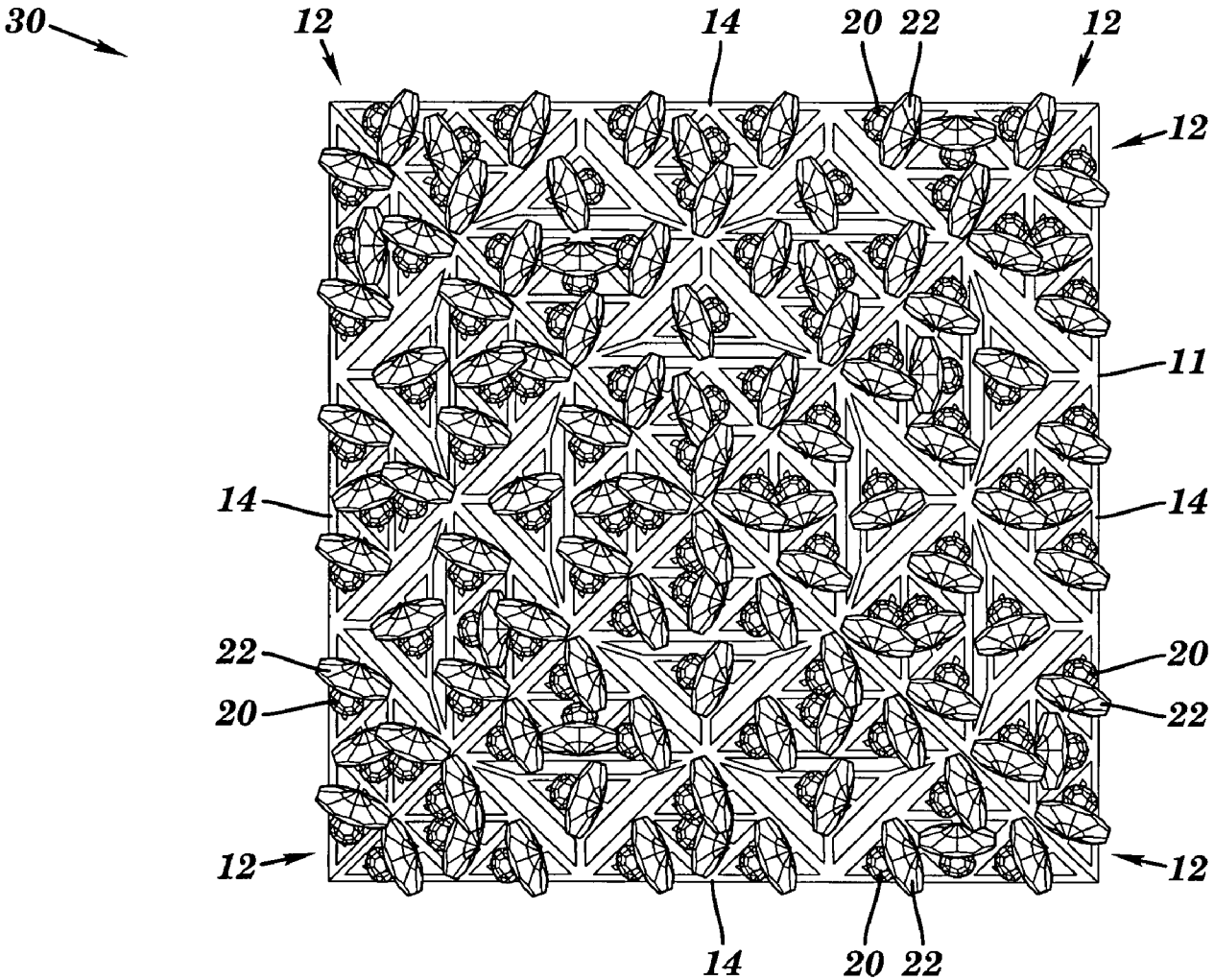
FIGS. 7A and 7B are a bottom view and a side view, respectively, of an ornamental fixture according to one aspect of the present invention.
Figure 7B:
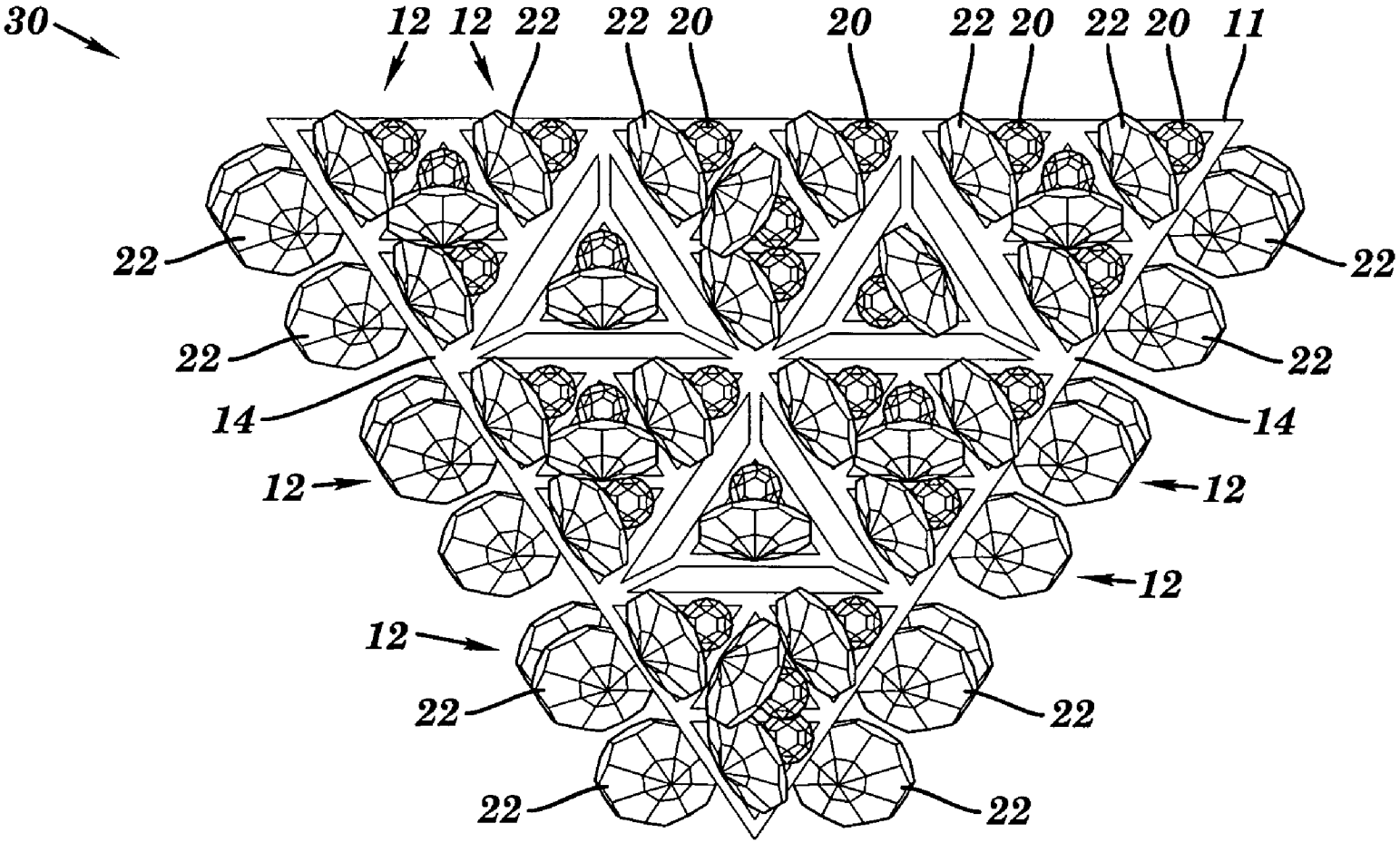

FIGS. 7A and 7B represent a bottom view and a side view, respectively, of an assembled ornamental fixture 30 comprising frame 11, panels 14, and mounting arrangements 12 having beads 20 and jewels 22 as described with respect to FIGS. 1 through 6. According to this aspect of the invention, the four (4) frame panels 14 shown in FIG. 1 have had beads 20 and jewels 22 mounted in mounting arrangement 12 as described in FIGS. 3 through 5. The unassembled, flat frame 11 shown in FIG. 1 was then folded or bent along the dividing lines of the panels 14 to provide the pyramidal structure shown in FIGS. 7A and 7B. As characterized by aspects of the present invention, in FIGS. 7A and 7B, beads 20 and jewels 22 are mounted and retained by mounting arrangement 12 without the need for additional mounting hardware or adhesives. Beads 20 and jewels 22 are simply retained by mounting pins 18 and the internal surfaces of apertures 16. Ornamental fixture 30 may be used alone or with multiple similar or different fixtures in an ornamental fixture, for example, ornamental light fixtures, for instance, a chandelier, lamp, or wall sconce.

Figure 8:
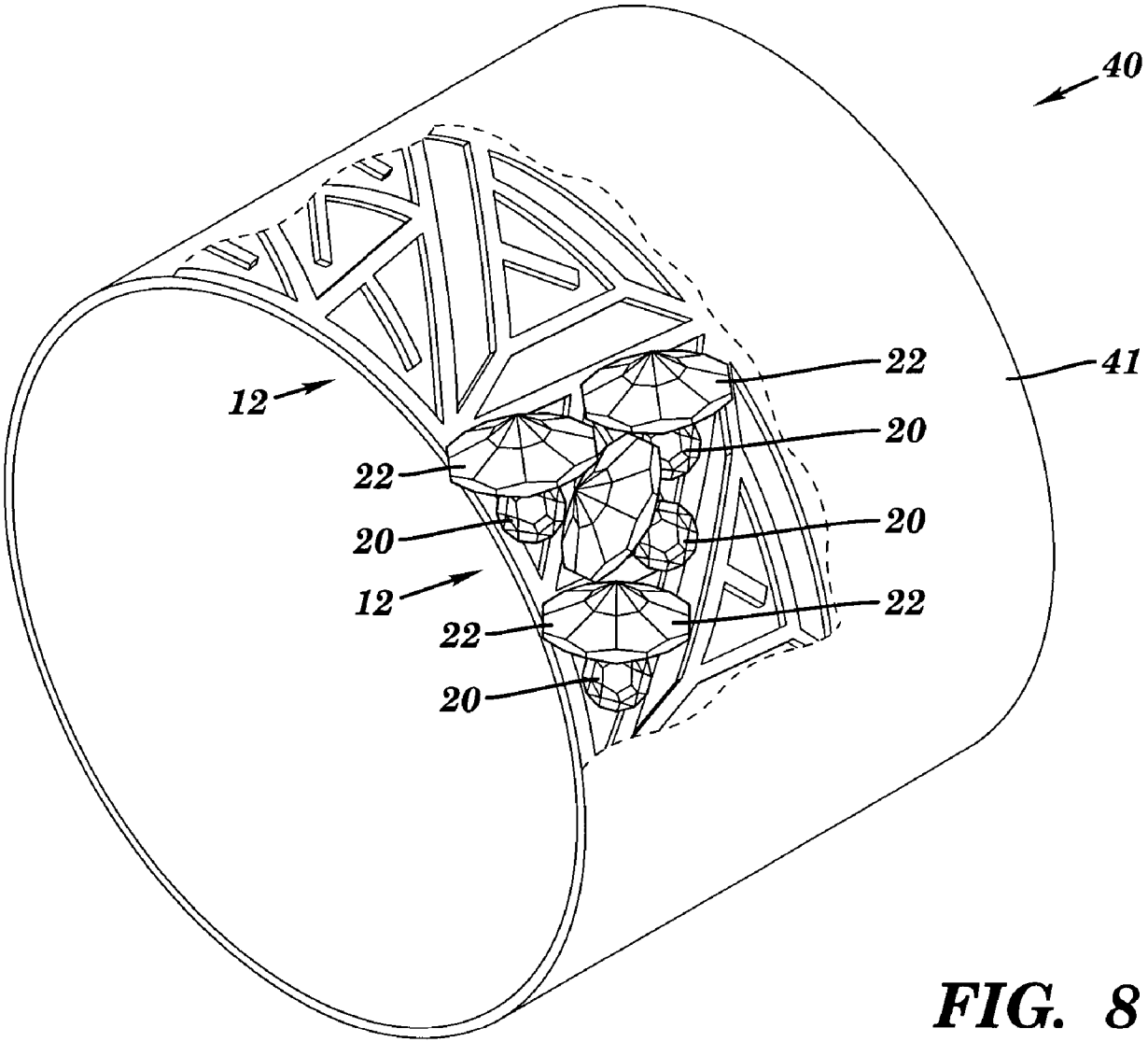
FIG. 8 is a perspective view of another ornamental fixture according to one aspect of the present invention.

FIG. 8 is a perspective view of another ornamental fixture 40 according to one aspect of the present invention. In this aspect of the invention, ornamental fixture 40 comprises a cylindrical frame 41 having mounting arrangements 12 which retain beads 20 and jewels 22 as described with respect to FIGS. 1 through 6. In this aspect of the invention, cylindrical frame 41 was produced by rolling the flat frame 11 shown in FIG. 1. For the sake of clarity, only a representative portion of cylindrical frame 41 having representative beads 20 and jewels 22 is shown in FIG. 8. Ornamental fixture 40 may be used alone or with multiple similar or different fixtures in an ornamental fixture, for example, ornamental light fixtures, for instance, a chandelier, lamp, or wall sconce.

FIGS. 7A, 7B, and 8 illustrate another aspect of the invention that is not found in the prior art. Some of the ornaments illustrated in these figures, for example, octagonal crystal jewels 22 in FIGS. 7A, 7B, and 8, are ornaments having perforations that do not pass through the center of the ornament, that is, the location of the center of gravity of these types of ornaments are offset from the location of the through hole by which the ornament is mounted to mounting post 18. According to the prior art, the orientation of such ornaments, for example, pendalogs or pear-shaped pendants, when mounted to a frame is typically governed by gravity. Such ornaments typically are oriented whereby their axes are directed downward due to gravity acting at their centers of gravity. According to the prior art, any other type of non-vertical orientation typically requires the use of complex and expensive brackets, hooks, or other attachments to orient the ornament in a non-vertical direction. According to one aspect of the present invention, mounting arrangements are provided whereby such ornaments can be mounted in any desired orientation without the need for any type of additional mounting hardware. The various orientations octagonal crystal jewels 22 shown in FIGS. 7A, 7B, and 8 are examples of just some of the non-conventional, non-vertical crystal orientations that are provided by the present invention. The general features of this aspect of the invention are illustrated in FIG. 11.

Figure 11:
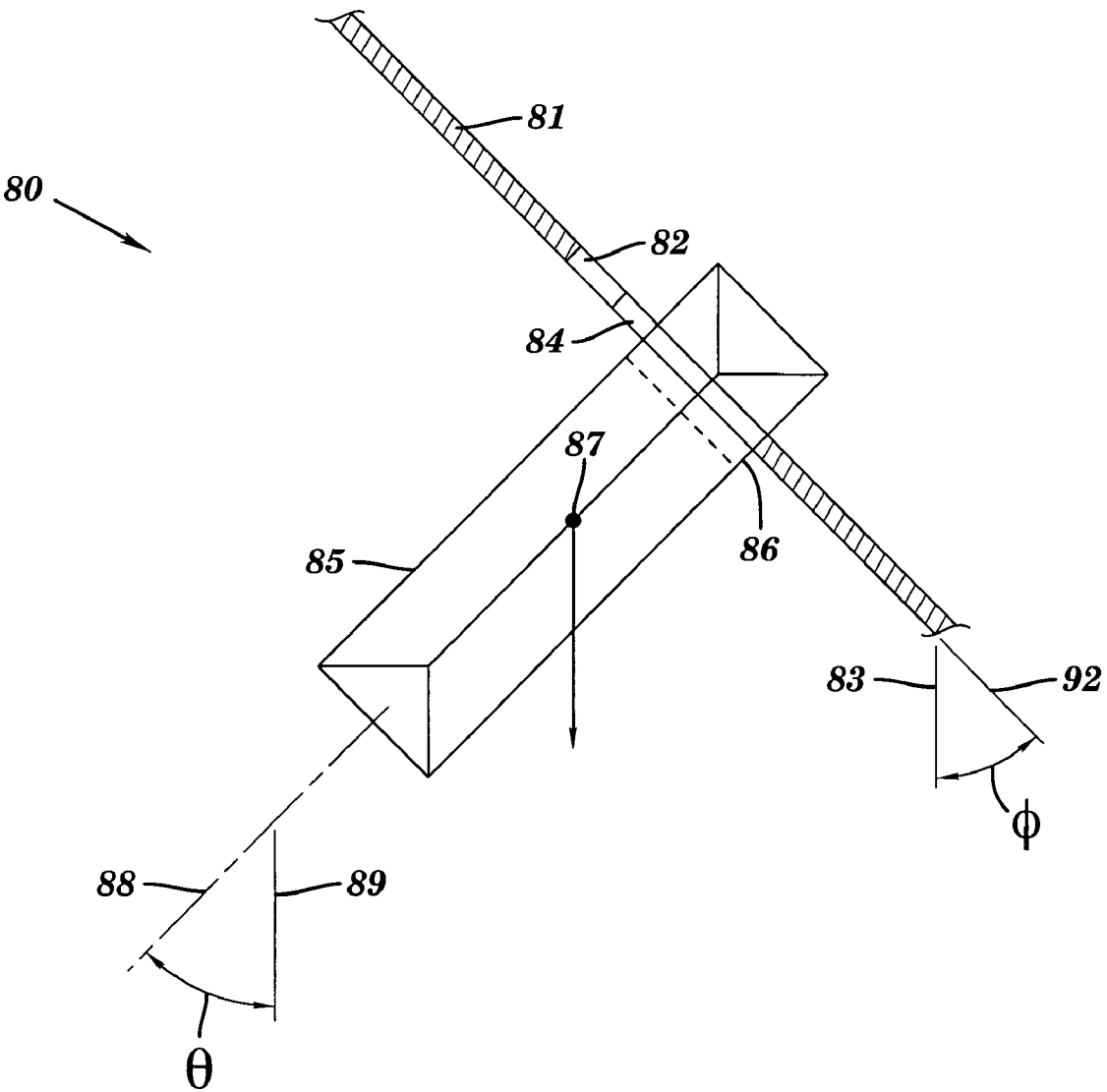
FIG. 11 illustrates another aspect of the present invention which provides oriented mounting of ornaments.

FIG. 11 illustrates another mounting arrangement 80 according to another aspect of the present invention in which the orientation of the mounting of one or more ornaments can be varied with little or no influence from gravity. FIG. 11 shows a representative cross section of a mounting frame 81, for example, a frame similar to frame 11 discussed above. In this aspect of the invention, the surface, identified by dotted line 92, of frame 81 is oriented at an angle (p to the vertical, represented by dotted line 83. Frame 81 includes at least one aperture 82 (for example, a triangular aperture as shown in FIGS. 1 through 6) having at least one mounting post 84, for example, a mounting post similar to mounting post 18 discussed above. As shown in FIG. 11, an ornament 85 having through hole 86 (shown in phantom) is mounted to mounting post 84 in a manner typical of the mounting arrangements described above, that is, mounting post 84 may be deflected to mount ornament 85. According to this aspect of the invention, ornament 85 has a center of gravity identified by point 87 and an axis 88 that is oriented at an angle θ to the vertical, as represented by dotted line 89. According to this aspect of the invention, through hole 86 of ornament 85 may not pass through center of gravity 87, however, according to the present invention, the orientation of axis 88 is not vertical, as would be dictated by gravity and the conventional art. For example, according to the prior art, since through hole 86 does not pass through center of gravity 87, a bending moment is produced in ornament 85 that attempts to orient ornament 85 in a vertical direction, for example, whereby angle θ is substantially zero. However, according to this aspect of the present invention, the bending moment caused by the offset of through hole 86 from center of gravity 87 is resisted by contact between ornament 85 and at least mounting post 84 and, in one aspect, the internal surfaces of aperture 82.

According to this aspect of the present invention, the axis of ornament 85 may be oriented in any desired direction. For example, in one aspect of the invention, ornament 85 may be mounted to mounting post 84 whereby angle θ is about equal to angle ϕ, for instance, if angle ϕ is about 45 degrees, angle θ may be about 45 degrees. In another aspect of the invention, angle θ may vary from angle ϕ. For example, in this aspect of the invention, the orientation of mounting post 84, which in the prior aspects of the invention is shown substantially oriented parallel to the surface of frame 81, may vary from being parallel to the surface of frame 81. For example, mounting post 84 may have an angle that varies from the angle of orientation of surface 92, that is, varies from angle ϕ. The variation of the orientation of ornament 85 may also be defined or assisted by the geometry of the internal surfaces of aperture 82. In one aspect of the invention, the orientation of mounting post 84 relative to the vertical may be about equal to angle θ, for example, when through hole 86 is substantially perpendicular to axis 88. In another aspect of the invention, through hole 86 may not be substantially perpendicular to axis 88 and angle θ may vary from the angle of orientation of mounting post 84. Other geometric configurations of the angle of mounting post 84 and angles θ and ϕ will be apparent to those familiar with the art. According to one aspect of the invention, surface 82 may be a planar surface, as shown in FIGS. 7A and 7B, or a curved surface, as shown in FIG. 8.

Figure 9:
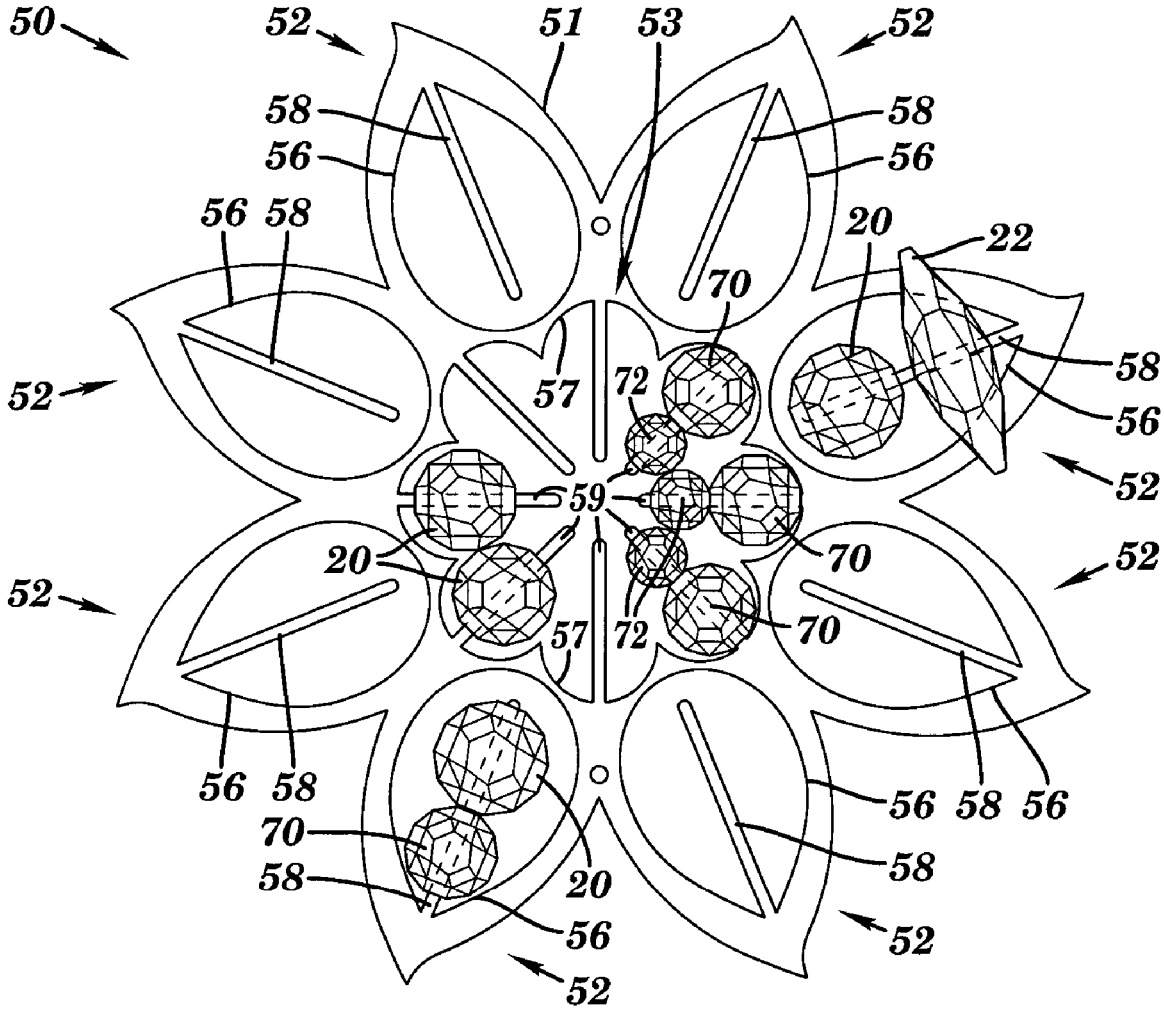
FIG. 9 is a plan view of a mounting arrangement according to another aspect of the invention.

FIG. 9 is a plan view of an ornament mounting arrangement 50 according to another aspect of the invention. In this aspect of the invention, mounting arrangement 50 comprises a frame 51 (for example, a frame having the properties described above for frame 11) and having leaf-shaped mounting arrangements 52 and 53. According to this aspect of the invention, mounting arrangement 52 includes a floral-like aperture 56 and a mounting post 58 and mounting arrangement 53 includes a floral-like aperture 57 and a plurality of mounting posts 59. A representative ornamental bead 20 and jewel 22 are shown mounted in mounting arrangement 52 and representative beads 20 are shown mounted in mounting arrangement 53. Also, representative beads 20 and 70 are also shown mounted in mounting arrangement 52; in this example, bead 70 is smaller than bead 20. In addition, multiple representative beads 70 and 72 are shown mounted in mounting arrangement 53; in this example, bead 72 is smaller than bead 70. According to this aspect of the invention, beads 20, 70, and 72 and jewels 22 may be mounted to mounting posts 58 and 59 in a fashion similar to the mounting of ornaments on mounting post 18 shown in FIGS. 3 through 5. That is, ornaments 20, 22, 70, and 72 may be mounted in arrangements 52 and 53 by deflecting posts 58 and 59 from the first position shown to a second position and then returning posts 58 and 59 to the first position as shown in FIG. 9. As is characteristic of aspects of the present invention, ornaments 20, 22, 70, and 72 are then retained in mounting arrangements 52 and 53 by respective posts 58 and 59 and the respective internal surfaces of apertures 56 and 57. In one aspect of the invention, ornaments may also be retained in mounting arrangement 50 due to contact with other ornaments. For example, as shown in mounting arrangement 53 in FIG. 9, ornaments 20 and 72 mounted on mounting pins 59 may also be retained on pins 59 due to contact with adjacent ornaments 20, 72. Also, as shown in FIG. 9, ornament 20 in mounting arrangement 53 may be retained on pins 59 due to contact with one or more adjacent ornaments 20. In one aspect of the invention, ornaments 20, 22, 70, and 72 may be retained by mounting posts 58 and/or 59, the internal surfaces of apertures 56 and/or 57, and one or more adjacent ornaments. In another aspect of the invention, ornaments 20, 22, 70, and 72 may be retained by mounting posts 58 and/or 59 and one or more adjacent ornaments, that is, only by one or more adjacent ornaments without the use of the internal surfaces of apertures 56 or 57. Ornament mounting arrangement 50 may be used alone or with multiple similar or different arrangements in an ornamental fixture, for example, ornamental light fixtures, for instance, a chandelier, lamp, or wall sconce.

Figure 10:
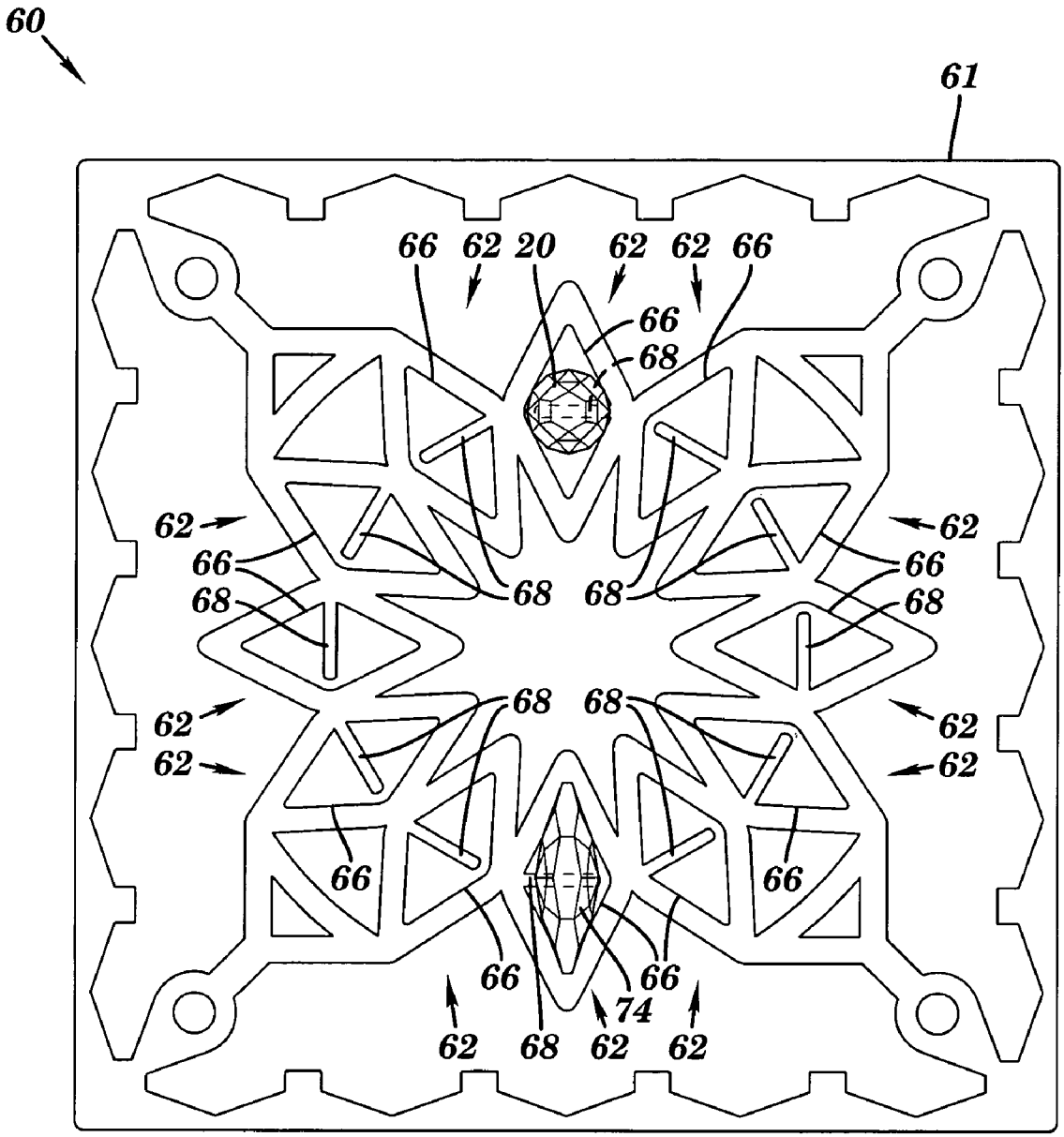
FIG. 10 is a plan view of a mounting arrangement according to still another aspect of the invention.

FIG. 10 is a plan view of another ornament mounting arrangement 60 according to another aspect of the invention. In this aspect of the invention, mounting arrangement 60 comprises a frame 61 (for example, a planar or circular frame having the properties described above for frame 11) and having a plurality of mounting arrangements 62. According to this aspect of the invention, each mounting arrangement 62 includes a diamond-shaped aperture 66 and a mounting post 68. Representative ornamental bead 20 and jewel 74 are shown mounted in two mounting arrangements 62. Again, according to this aspect of the invention, bead 20 and jewel 74 may be mounted to mounting posts 68 in a fashion similar to the mounting of ornaments on mounting post 18 shown in FIGS. 3 through 5. In one aspect of the invention, jewel 74 is an ornament having a through hole that does not pass through the center of jewel 74, for example, jewel 74 may be an octagon crystal jewel similar to jewel 22 described previously, though other types of ornaments having off-center through holes may be used. As is characteristic of aspects of the present invention, ornaments 20 and 74 are retained in mounting arrangements 62 by posts 68 and the internal surfaces of apertures 66. Ornament mounting arrangement 60 may be used alone or with multiple similar or different arrangements in an ornamental fixture, for example, an ornamental light fixture, for instance, a chandelier, lamp, or wall sconce.

Figure 12:
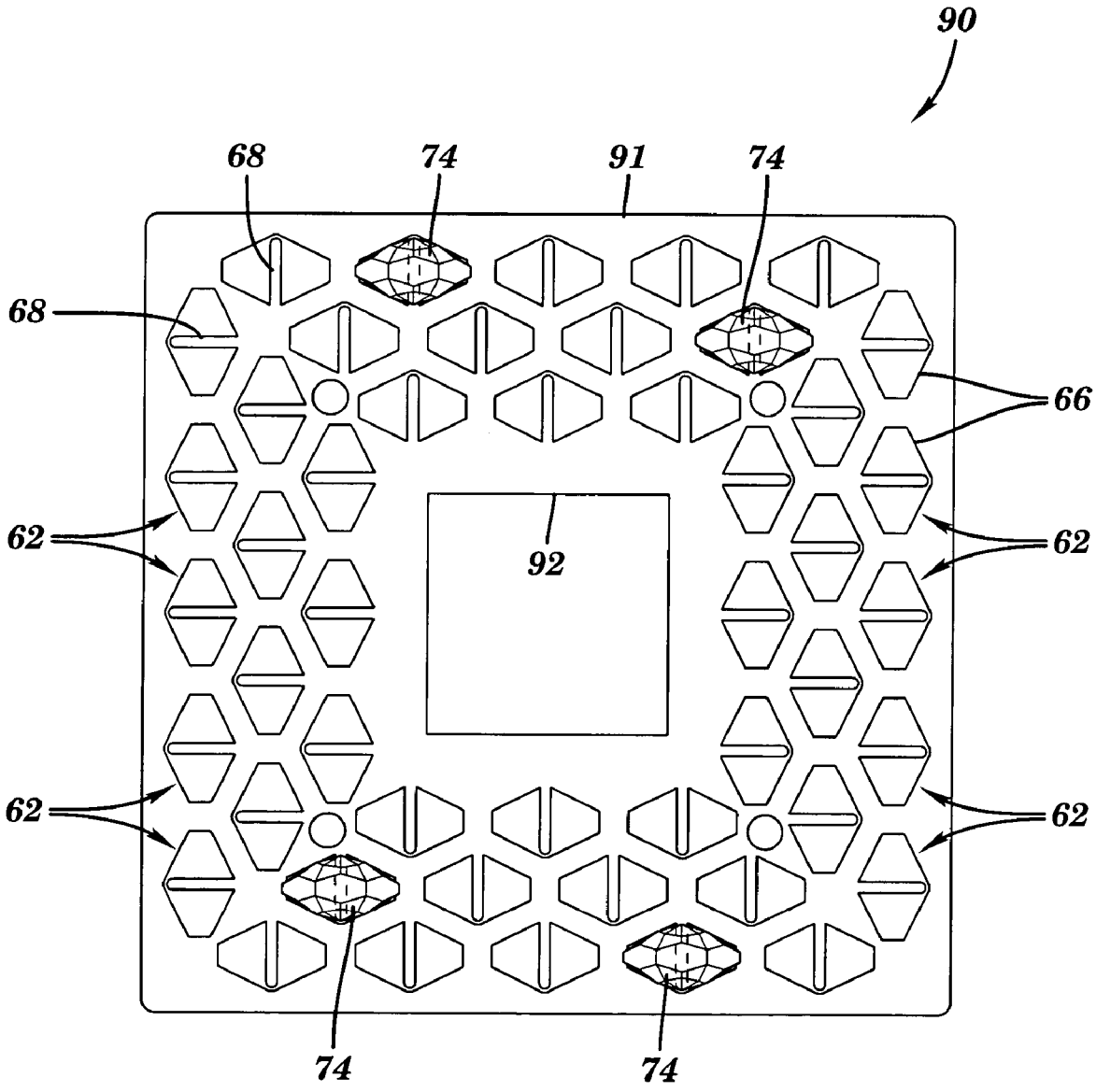
FIG. 12 illustrates another aspect of the present invention.

According to another aspect of the invention, mounting arrangement 62 shown in FIG. 10 may be incorporated into a mounting arrangement 90 as shown in FIG. 12. In this aspect of the invention, a plurality of mounting arrangements 62 in one or more rows in a frame 91 (for example, a planar or circular frame having the properties described above for frame 11) is provided. Each arrangement 62 includes apertures 66 (for example, diamond-shaped apertures) and mounting posts 68 as shown in FIG. 12. Frame 91 may be rectangular as shown, but any circular, oval, or polygonal shape may be used, and may include a central aperture 92, for example, a circular, square, or rectangular aperture. As described with respect to FIG. 10, mounting arrangements 62 may have any type of ornament mounted to mounting posts 68. In one aspect of the invention, a plurality of ornaments, for example, octagonal crystal jewels 74 (similar to jewel 74 shown in FIG. 10) may be mounted on mounting arrangements 62. Four representative jewels 74 are shown in FIG. 12, though typically most if not all of mounting arrangements 62 include a jewel 74. In one aspect of the invention, jewel 74 is an ornament having a through hole that does not pass through the center of jewel 74, for example, jewel 74 may be an octagon crystal jewel similar to jewel 22 described previously, though other types of ornaments having off-center through holes may be used. As is characteristic of aspects of the present invention, jewels 74 are retained in mounting arrangements 62 by posts 68 and the internal surfaces of apertures 66, for example, as shown in FIG. 11. Ornament mounting arrangement 90 may be used alone or with multiple similar or different arrangements in an ornamental fixture, for example, an ornamental light fixture, for instance, a chandelier, lamp, or wall sconce.

As will be appreciated by those skilled in the art, features, characteristics, and/or advantages of the ornament mounting arrangements, ornament mounting methods, and ornamented fixtures described herein, may be applied and/or extended to any embodiment (for example, applied and/or extended to any portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims and their equivalents.

I claim:

1. An arrangement for mounting a decorative ornament comprising:

a frame having an aperture, the aperture having an internal surface; and at least one mounting post projecting from the frame, the at least one mounting post having a first end mounted to the frame and a second free end, the second free end adapted for insertion through a perforation in the ornament;

wherein the ornament is retained by the mounting post and the internal surface of the aperture when the ornament is mounted to the mounting post.

2. The arrangement as recited in claim 1, wherein the first end is integrally mounted to the frame.

3. The arrangement as recited in claim 1, wherein the internal surface of the aperture comprises a continuous internal surface.

4. The arrangement as recited in claim 1, wherein the mounting post comprises a flexible mounting post.

5. The arrangement as recited in claim 4, wherein the flexible mounting post is adapted for one of elastic and plastic deflection.

6. The arrangement as recited in claim 4, wherein the flexible mounting post is adapted for plastic deflection from a first position to a second position for mounting the ornament.

7. The arrangement as recited in claim 6, wherein the aperture defines a plane and wherein first position is substantially parallel to the plane of the aperture and the second position is substantially non-parallel to the plane of the aperture.

8. The arrangement as recited in claim 1, wherein the aperture compresses one of a circular aperture, an elliptical aperture, a polygonal aperture, and a triangular aperture.

9. The arrangement as recited in claim 1, wherein the at least one mounting post comprises a plurality of mounting posts.

10. The arrangement as recited in claim 1, wherein the decorative ornament comprises one of a bead, crystal, stone, and gem.

11. A method for mounting a decorative ornament to a frame having an aperture and a flexible mounting post having a first end mounted to the frame and a second free end, the aperture having an internal surface, the method comprising:

deflecting the mounting post from a first position to a second position;

mounting the ornament on the mounting post in the second position;

deflecting the mounting post having the ornament to the first position; and retaining the ornament in the aperture by means of the mounting post and the internal surface of the aperture.

12. The method as recited in claim 11, wherein deflecting comprises one of elastic deflecting and plastic deflecting.

13. The method of claim 11, wherein the aperture defines a plane, and wherein in the first position of the mounting post is substantially parallel to a plane of the aperture and wherein in the second position of the mounting post is substantially non-parallel to a plane of the aperture.

14. The method of claim 13, wherein deflecting the mounting post from a first position to a second position comprises plastically deflecting the mounting post whereby the mounting post makes an angle of at least 5 degrees with the plane of the aperture.

15. An ornamental fixture comprising:

a frame having at least one aperture, the at least one aperture having an internal surface; and at least one mounting post projecting from the frame, the at least one mounting post having a first end mounted to the frame and a second free end, the second free end adapted for insertion through a perforation in the ornament;

wherein an ornament is retained by the at least one mounting post and the internal surface of the at least one aperture when the ornament is mounted to the at least one mounting post.

16. The ornamental fixture as recited in claim 15, wherein the at least one mounting post comprises a mounting post adapted for deflection from a first position to a second position for mounting the ornament.

17. The arrangement as recited in claim 16, wherein the at least one aperture defines a plane and wherein the first position is substantially parallel to the plane of the aperture and the second position is substantially non-parallel to the plane of the aperture.

18. The ornamental fixture as recited in claim 15, wherein the at least one aperture comprises a plurality of apertures and the at least one mounting post comprises a plurality of mounting posts.

19. The ornamental fixture as recited in claim 15, wherein the ornamental fixture comprises a light fixture.

20. The ornamental fixture as recited in claim 15, wherein the light fixture comprises one of a chandelier, lamp, and wall sconce.

21. An arrangement for mounting a decorative ornament having an axis and a mounting hole that does not pass through the center of gravity of the ornament, the arrangement comprising:

a frame having a surface and an aperture; and at least one mounting post projecting from the frame, the mounting post having a first end mounted to the frame and a second free end, the second free end adapted for insertion through the mounting hole of the ornament;

wherein when the ornament is mounted to the mounting post, the axis of the ornament makes an angle greater than 0 degrees with the vertical.

22. The arrangement as recited in claim 21, wherein the axis of the ornament makes an angle greater than 5 degrees with the vertical.

23. The arrangement as recited in claim 21, wherein the surface of the frame defines a line which makes an angle $\phi$ with the vertical, and wherein the axis of the ornament makes an angle $\theta$ with the vertical, and wherein angle $\theta$ is about equal to angle $\phi$.

24. The arrangement as recited in claim 21, wherein the surface of the frame defines a line which makes an angle $\phi$ with the vertical, and wherein the axis of the ornament makes an angle $\theta$ with the vertical, and wherein angle $\theta$ is not equal to angle $\phi$.

25. The arrangement as recited in claim 1, wherein the ornament is further retained by an adjacent ornament.

26. The method as recited in claim 11, wherein the method further comprises retaining the ornament in the aperture by means of contact with an adjacent ornament.

27. The ornamental fixture as recited in claim 15, wherein the ornament is further retained by an adjacent ornament.

28. The arrangement as recited in claim 1, wherein the at least one mounting post projects into the aperture.

29. The arrangement as recited in claim 1, wherein the ornament includes an axis and the ornament peroration does not pass through a center of gravity of the ornament, and wherein the ornament is retained by the mounting post and the internal surface of the aperture wherein the axis of the ornament makes an angle greater than 0 degrees with a vertical line.

30. The arrangement as recited in claim 15, wherein the at least one mounting post projects into the aperture.

31. The arrangement as recited in claim 15, wherein the ornament includes an axis and the ornament peroration does not pass through a center of gravity of the ornament, and wherein the ornament is retained by the mounting post and the internal surface of the aperture wherein the axis of the ornament makes an angle greater than 0 degrees with a vertical line.

32. The arrangement as recited in claim 21, wherein the at least one mounting post comprises a first end mounted to the frame and a second free end.

* * * * *